US007405710B2

(12) United States Patent
Bisiules et al.

(10) Patent No.: US 7,405,710 B2
(45) Date of Patent: Jul. 29, 2008

(54) MULTIBAND DUAL POLARIZED ADJUSTABLE BEAMTILT BASE STATION ANTENNA

(75) Inventors: Peter John Bisiules, LaGrange Park, IL (US); John H. Coult, Chicago, IL (US); Ching-Shun Yang, Naperville, IL (US); Joselito de la Cruz Gavilan, Bolingbrook, IL (US); Martin Zimmerman, Chicago, IL (US)

(73) Assignee: Andrew Corporation, Westchester, IL (US)

( * ) Notice: Subject to any disclaimer, the term of this patent is extended or adjusted under 35 U.S.C. 154(b) by 287 days.

(21) Appl. No.: 10/399,342

(22) PCT Filed: Mar. 14, 2003

(86) PCT No.: PCT/US03/07873

§ 371 (c)(1),
(2), (4) Date: Jul. 12, 2004

(87) PCT Pub. No.: WO03/083992

PCT Pub. Date: Oct. 9, 2003

(65) Prior Publication Data

US 2004/0252071 A1 Dec. 16, 2004

Related U.S. Application Data

(60) Provisional application No. 60/433,352, filed on Dec. 13, 2002, provisional application No. 60/433,353, filed on Dec. 13, 2002, provisional application No. 60/433,354, filed on Dec. 13, 2002, provisional application No. 60/367,646, filed on Mar. 26, 2002.

(51) Int. Cl.
*H01Q 21/26* (2006.01)

(52) U.S. Cl. ..... 343/797

(58) Field of Classification Search ..... 343/797, 343/792–795, 799, 810, 814, 816, 853
See application file for complete search history.

(56) References Cited

U.S. PATENT DOCUMENTS

| | | | |
|---|---|---|---|
| 4,218,685 | A | 8/1980 | Ellis, Jr. |
| 4,434,425 | A | 2/1984 | Barbano |
| 4,555,708 | A | 11/1985 | Waineo et al. |
| 5,512,914 | A | 4/1996 | Hadzoglou et al. |
| 5,548,299 | A | 8/1996 | Tsuda et al. |
| 5,798,675 | A | 8/1998 | Drach |
| 5,838,282 | A | 11/1998 | Lalezari et al. |
| 5,917,455 | A | 6/1999 | Huyuh et al. |

(Continued)

FOREIGN PATENT DOCUMENTS

DE 198 23 749 A1 12/1999

(Continued)

*Primary Examiner*—Huedung Mancuso
(74) *Attorney, Agent, or Firm*—Welsh & Katz, Ltd.

(57) ABSTRACT

A method and apparatus are provided for constructing a multi-band antenna (10). The method includes the steps of providing a plurality of combination-type dipole assemblies (114, 116, 118, 120, 122, FIG. 7) each defined by a box-type dipole array (36) disposed coaxially within a circular-type dipole array (134), disposing the plurality of combination-type dipole assemblies along a substantially straight line (34) over a ground plane (140) and disposing a plurality of crossed-type dipole antenna arrays along the substantially straight line in alternating order with the plurality of combination-type dipole assemblies.

43 Claims, 6 Drawing Sheets

U.S. PATENT DOCUMENTS 5,940,044 A 8/1999 Smith
6,025,812 A * 2/2000 Gabriel et al. ..... 343/797
6,034,649 A 3/2000 Wilson et al.
6,072,439 A 6/2000 Ippolito et al.
6,091,365 A * 7/2000 Derneryd et al. ..... 343/700 MS
6,195,063 B1 2/2001 Gabriel et al.
6,198,458 B1 3/2001 Heinz et al.
6,211,841 B1 4/2001 Smith et al.
6,285,336 B1 9/2001 Zimmerman et al.
6,310,585 B1 10/2001 Marino
6,313,809 B1 11/2001 Gabrial et al.
6,323,820 B1 11/2001 Haunberger
6,333,720 B1 12/2001 Gottl et al.
6,339,407 B1 1/2002 Gabriel et al.
6,339,497 B1 1/2002 Pieri et al.
6,819,300 B2 * 11/2004 Gottl ..... 343/799
2003/0011529 A1 1/2003 Gottl
2003/0090431 A1 5/2003 Gottl

FOREIGN PATENT DOCUMENTS

WO WO 95/00980 A 1/1995
WO WO 99/62139 12/1999
WO WO 00/39894 7/2000
WO WO 02/05383 A1 1/2002

* cited by examiner

80

74
14,(114)
16,(116)
18,(118)
20,(120)
22,(122)
34,(134)
DOWNTILT CONTROL +45°
CPU
DOWNTILT CONTROL -45°
86
82
84
OUT
OUT

MULTIBAND DUAL POLARIZED ADJUSTABLE BEAMTILT BASE STATION ANTENNA

This application is a continuation-in-part of the following U.S. Provisional Patent Applications: 1) Provisional Patent Application No. 60/367,646 filed Mar. 26, 2002, entitled Multiband Dual Polarized Adjustable Beamtilt Base Station Antenna, 2) U.S. Provisional Patent Application No. 60/433,352, filed Dec. 13, 2002, entitled Improvements Relating to Dipole Antennas, 3) U.S. Provisional Patent Application No. 60/433,353, filed Dec. 13, 2002, entitled Multi-band Antenna, and 4) U.S. Provisional Patent Application No. 60/433,354, filed Dec. 13, 2002, entitled Antenna. U.S. Provisional Patent Application Nos. 60/367,646, 60/433,352, 60/433,353, and 60/433,354 are hereby incorporated by reference in their entirety.

FIELD OF THE INVENTION

The field of the invention relates to cellular base stations and more particularly to antennas and antenna arrays for cellular base stations.

BACKGROUND OF THE INVENTION

Cellular systems are generally known. Typically, a geographic area of a cellular system is divided into a number of overlapping areas (cells) that may be serviced from nearby base stations. The base stations may be provided with a number of directional antenna that preferentially transceive signals with mobile cellular devices within each assigned cell.

Cellular systems are typically provided with a limited radio spectrum for servicing mobile cellular devices. Often a frequency reuse plan is implemented to minimize interference and maximize the efficiency of channel reuse.

An important factor in channel reuse is the presence of a base station antenna that radiates and receives in predictable patterns. Often base station antennas divide the area around the base station into 60 degree sectors extending outwards from the base station.

While existing systems work well, the increasing use of cellular devices have exacerbated the need for channel reuse in even smaller geographic areas. Further, the release of additional spectrum (e.g., for PCS, UTMS, UMTS, etc.) has resulted in the need for cellular antenna capable of operation over a greater range of frequencies. Because of the importance of cellular devices, a need exists for an antenna with increased spectral range of use and reduced size.

DETAILED DESCRIPTION OF AN ILLUSTRATED EMBODIMENT

Figure 1:
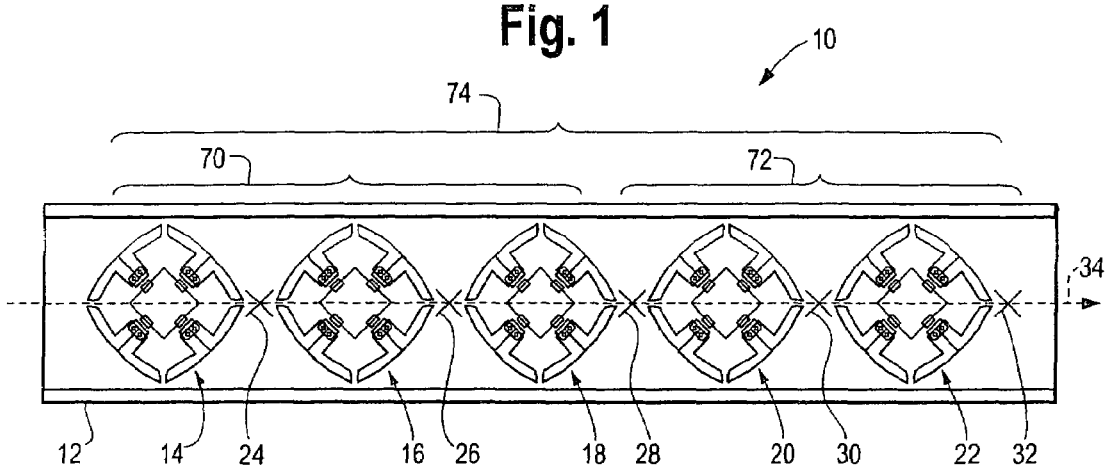
FIG. 1 depicts a multiband antenna in accordance with an illustrated embodiment of the invention.

FIG. 1 depicts a multiband base station antenna 10, shown generally in accordance with an illustrated embodiment of the invention. The antenna 10 may be used, as described below, for the transmission and reception of cellular, PCT/PCN, and UMTS signals.

Figure 3:
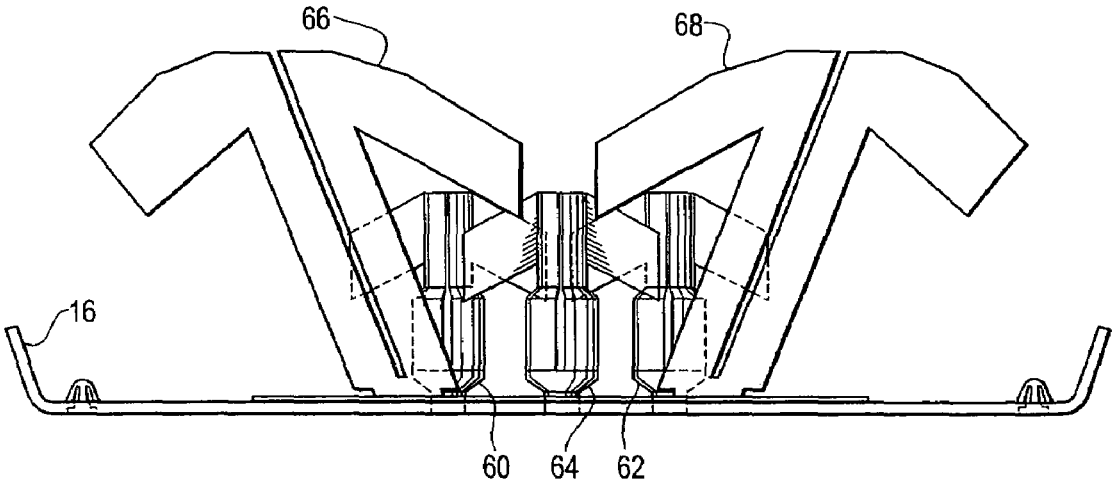
FIG. 3 is an end view of the antenna of FIG. 1.

As shown, the antenna 10 may include a number of box-type dipole antenna assemblies 14, 16, 18, 20, 22 (five shown in FIG. 1) and a number of crossed-type dipole antenna 24, 26, 28, 30, 32 all disposed along a common axis 34 over a common backplane 12. FIG. 3 depicts an end view of the antenna 10.

Figure 2:
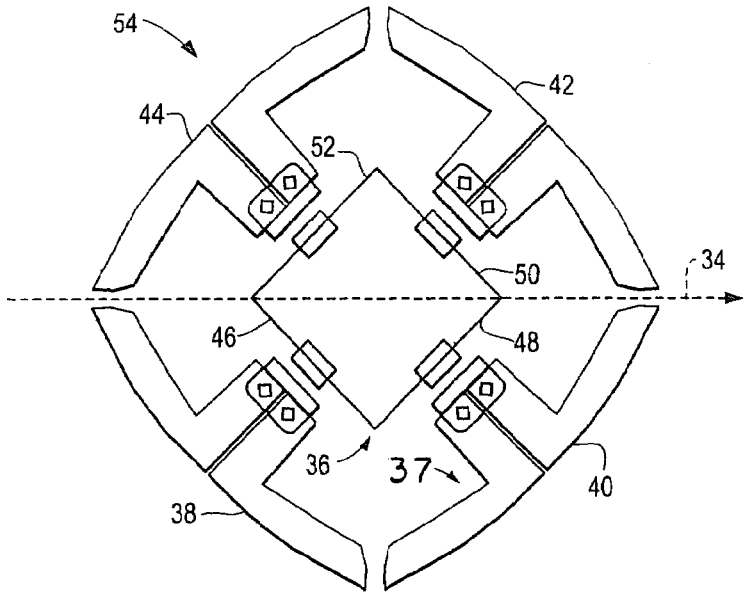
FIG. 2 depicts an antenna assembly of the antenna of FIG. 1.

FIG. 2 depicts a single box-type dipole assembly 54 that may be regarded as representative of the box-type dipole assemblies 14, 16, 18, 20, 22 of FIG. 1. As shown in FIG. 2, the box-type dipole assembly 54 includes a first box-type dipole array 36 coaxially disposed within a second box-type dipole array 37.

The second box-type dipole array 37 may include four dipoles 38, 40, 42, 44 arranged to form a square (i.e., a box) with the opposing ends of each dipole 38, 40, 42, 44 meeting at the corner of the formed square. The dipoles 38, 40, 42, 44 are sized and arranged to operate in the cellular range.

The dipoles 38, 40, 42, 44 are shown in FIGS. 2 and 3 as being angled away from the center of the square to provide a lower profile. However, there is no requirement that the dipoles be angled away and, in fact, the respective dipole elements (e.g., 38 and 46) of the two box-type arrays 37, 36 may be provided in a mutually parallel arrangement.

The first box-type dipole array 36 may similarly includes four dipoles 46, 48, 50, 52 arranged in the form of a box. As with the-second box-type dipole array 37, the opposing ends of the dipoles 46, 48, 50, 52 form the corners of the array 36. The dipoles 46, 48, 50, 52 of the first box-type dipole array 36 are sized and arranged to operate in the PCS/PCN and UMTS radio frequency ranges.

The crossed-type dipoles 24, 26, 28, 30, 32 may be fabricated from two dipoles sharing a common axis and aligned at a 90 degree angle one-to-another. The crossed types dipoles 24,26, 28, 30, 32 are sized and arranged to operate in the PCM/PCS and UMTS radio frequency range.

In the end view of FIG. 3, the crossed-type dipole 64 may be regarded as the crossed-type dipole 32 shown in FIG. 1. It may also be assumed that the end view of the box-type dipole assembly shown in FIG. 3 is the box-type dipole assembly 22 shown in FIG. 1 and generally shown in FIG. 2.

Consistent with that view, dipoles 66 and 68 of FIG. 3 may be the dipoles 40 and 42 generally shown in FIG. 2. Further dipoles 60, 62 of FIG. 3 may be dipoles 48, 50 of FIG. 2.

Figure 7:
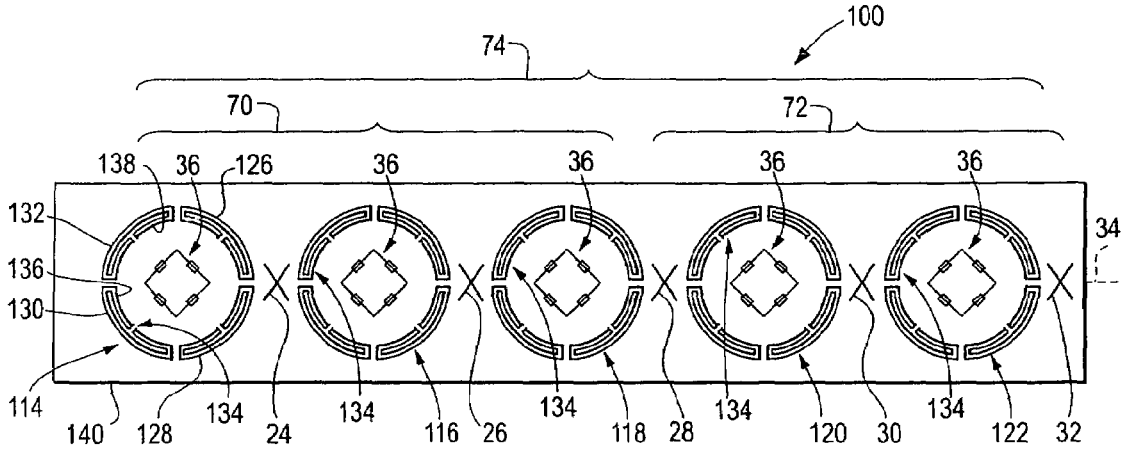
FIG. 7 depicts a multiband antenna in accordance with an alternate illustrated embodiment of the invention.

Under another illustrated embodiment of the invention, the box-type dipole arrays 37 of FIGS. 1 and 2 are replaced by circular-type dipole arrays (ring dipoles) 134 (FIG. 7). The circular-type dipole arrays 134 may be located coaxially with a respective box-type dipole array 36 to form the array of combination-type dipole assemblies 114, 116, 118, 120, 122 shown in FIG. 7. The combination-type dipole arrays 114, 116, 118, 120 may all be located along the centerline 34. The other elements of the antenna 100 may remain substantially as described above.

The circular-type dipole arrays 134 may be constructed identically and may each consist of four folded dipoles, such as folded dipoles 126, 128, 130, 132. The folded dipoles 126, 128, 130, 132, in turn, may also be substantially identical.

Each dipole 126, 128, 130, 132 may include a pair of arms 136, 138 that terminate on a first end with an antenna connection and terminate at a second, opposing end by being joined to the opposing arm 136, 138. Each arm 136, 138 may be generally curvilinear in shape and lie in a plane that is parallel to the plane of the ground plane 140. The axis of propagation of each curved-type dipole 126, 128, 130, 132 may be orthogonal to the ground plane 140.

The center of curvature of each folded dipole 126, 128, 130, 132 may lie at the center of the array 114, 116, 118, 120, 122 on the centerline 34. Each dipole 126, 128, 130, 132 may subtend an arc of approximately 90 degrees and together form the dipole ring 134. As may be seen from FIG. 7, the dipoles 126, 128, 130, 132 are generally concavo-convex when viewed along their axes of propagation; that is, they have a convex outer side and a concave inner side. In one illustrated embodiment, imaginary chords joining the ends of the folded dipoles 126, 128, 130, 132 are parallel to a corresponding dipole 46, 48, 50, 52 of the box-type dipole 36.

In order to improve reception of signals from portable units, the box-type antenna assemblies 14, 16, 18, 20, 22 (or the combination-type antenna assemblies 114, 116, 118, 120, 122) and cross-type antenna 24, 26, 28, 30, 32 may be rotated by an appropriate angle (e.g., 45 degrees) with respect to a longitudinal axis 34 of the antenna 10 (100). The net effect of such rotation is to give the first and second box-type arrays 37, 36 of the box-type antenna assemblies 14, 16, 18, 20, 22 (or the box-type arrays 36 and circular-type arrays 134) and the cross-type antennas 24, 26, 28, 30, 32 a plus and minus 45 degree polarization in the transmission and reception of signals.

The antenna 10 (100) may be divided into discrete sections for purposes of transmitting and receiving signals. For example, the second box-type dipole arrays 37 (circular-type arrays 134) within the assemblies 14, 16, 18, 20, 22 (114, 116, 118, 120, 122) along the entire length of the antenna 10 (100) may define a first antenna 74 operating within the cellular radio frequency range.

A second antenna 70 may be defined by first box-type dipole arrays 36 within assemblies 14, 16, 18 (114, 116, 118) and cross-type dipole antenna 24, 26. The second antenna 70 may operate within the PCN/PCS radio frequency range.

A third antenna 72 may be defined by first box-type dipole arrays 36 within assemblies 20, 22 (120, 122) and cross-type dipole antenna 28, 30, 32. The third antenna 72 may operate within the UMTS radio frequency range.

Further, the three antenna 70, 72, 74 may each be provided with a separate downtilt control. For example, FIG. 4 is a simplified downtilt control system 80 for the first antenna 70.

Figure 4:
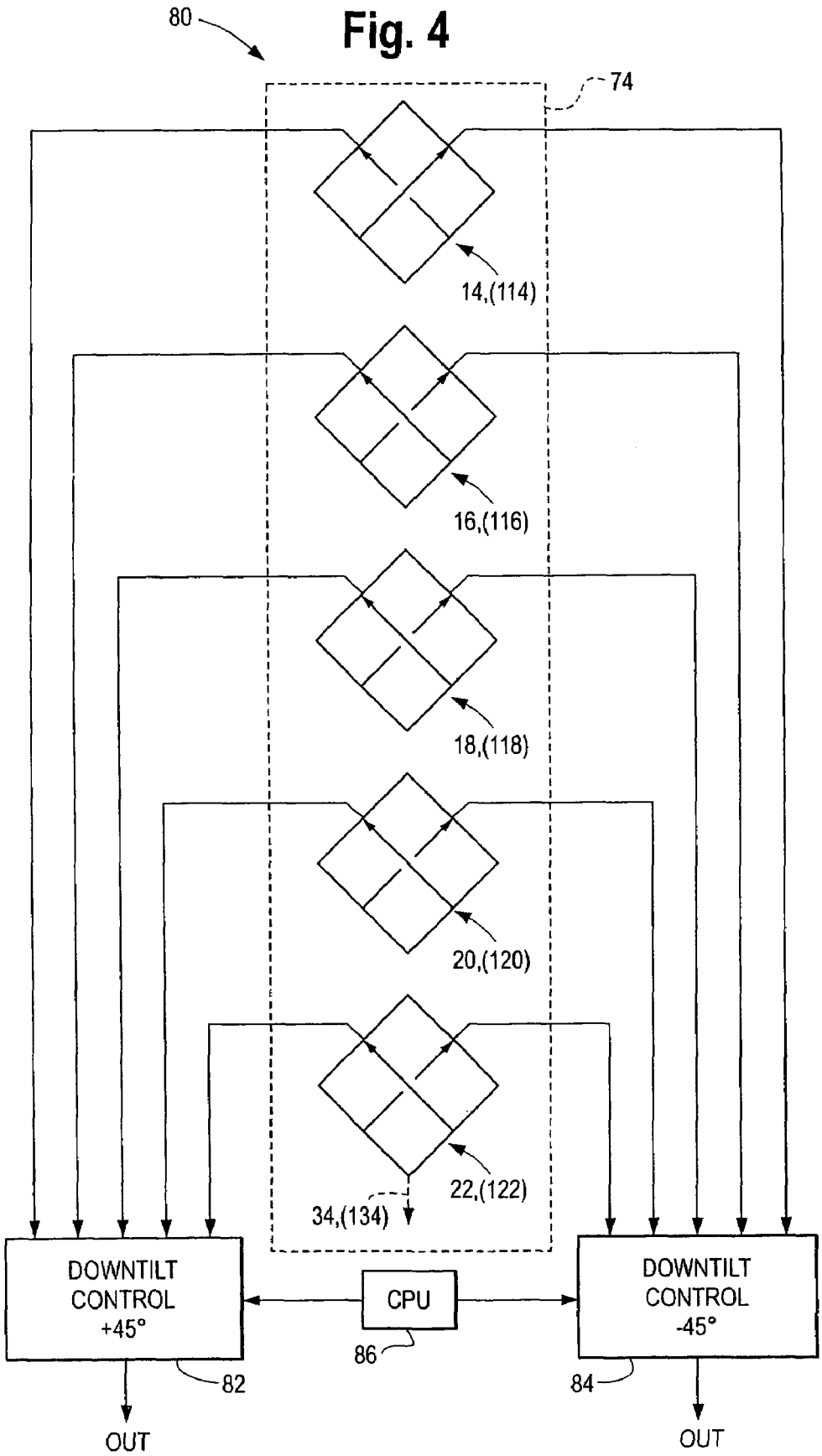
FIG. 4 is a simplified view of elements of the antenna of FIG. 1 operating in a first radio frequency band.

As shown in FIG. 4, a first set of parallel elements 38, 40 (130, 132) of assemblies 14, 16, 18, 20, 22 (114, 116, 118, 120, 122) may be connected to a first downtilt controller 82. A second set of parallel elements 40, 44 (126, 128) of assemblies 14, 16, 18, 20, 22 (114, 116, 118, 120, 122) may be connected to a second downtilt controller 84.

In order to control downtilt of the first antenna 74, a delay may be introduced into a signal from each of the antenna assemblies 14, 16, 18, 20, 22 (114, 116, 118, 120, 122). For example, in order to obtain a 2 degree change in downtilt, an appropriate incremental change in electrical length may be added to the signals from adjacent assemblies 14, 16, 18, 20, 22 (114, 116, 118, 120, 122).

Further, a central processing unit (CPU) 86 and servo controller (not shown) may be used to adjust the downtilt. Based upon the control from the CPU 86, the downtilt of the first set of polarized elements 38, 42 (128, 132) or second set of polarized elements 40, 44 (126, 130) of the first antenna 74 may be adjusted together or independently based upon the needs of the signal receiving environment.

Figure 5:
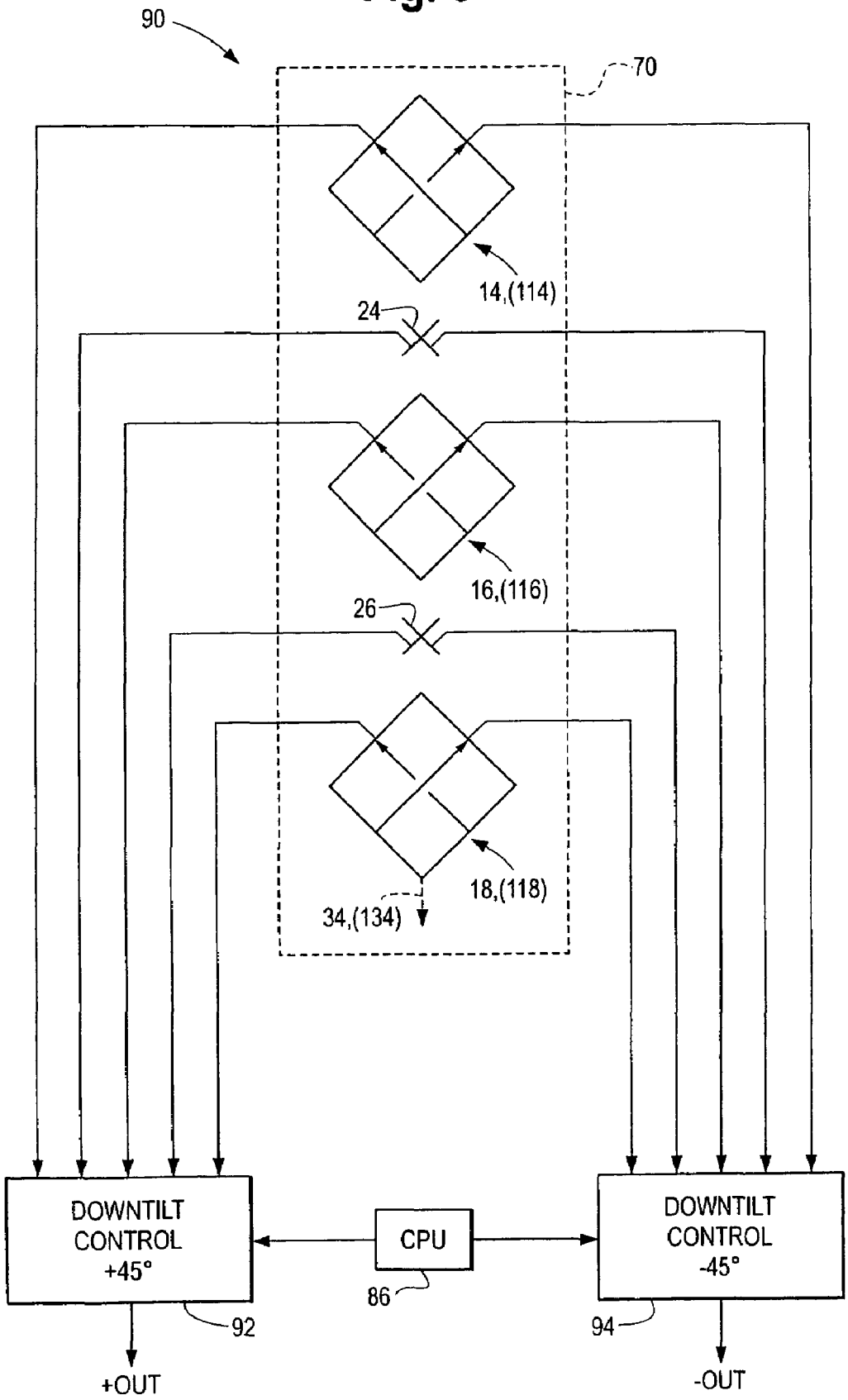
FIG. 5 is a simplified view of elements of the antenna of FIG. 1 operating in a second radio frequency band.

The downtilt of the second antenna 70 may also be adjusted to meet the needs of the operating environment. In order to control downtilt of the second antenna 70, an incremental delay may be introduced into a signal from the sequence of antenna elements including the first box-type array 36 of antenna assembly 14 (114), cross-type antenna 24, the first box-type array 36 of antenna assembly 16 (116), cross-type antenna 26, and the first box-type array 36 of antenna assembly 18 (118). As shown in FIG. 5, a first set of parallel elements 46, 50 of assemblies 14, 16, 18 (114, 116, 118) and a first set of elements of cross-type antenna 24, 26 (parallel to elements 46, 50) may be connected to a first downtilt controller 92. A second set of parallel elements 48, 52 of assemblies 14, 16, 18 (114, 116, 118) and in cross-type antenna 24, 26 may be connected to a second downtilt controller 94. In order to obtain a 2 degree change in downtilt, an appropriate incremental change in electrical length may be added to the signals from adjacent assemblies 14 (114), 24, 16 (116), 26, 18 (118).

Further, a central processing unit (CPU) 86 and servo controller (not shown) may be used to adjust the downtilt of the second antenna 70. Based upon the control from the CPU 86, the downtilt of the plus and minus 45 degree polarized elements of the second antenna 70 may be adjusted together or independently based upon the needs of the signal receiving environment.

Figure 6:
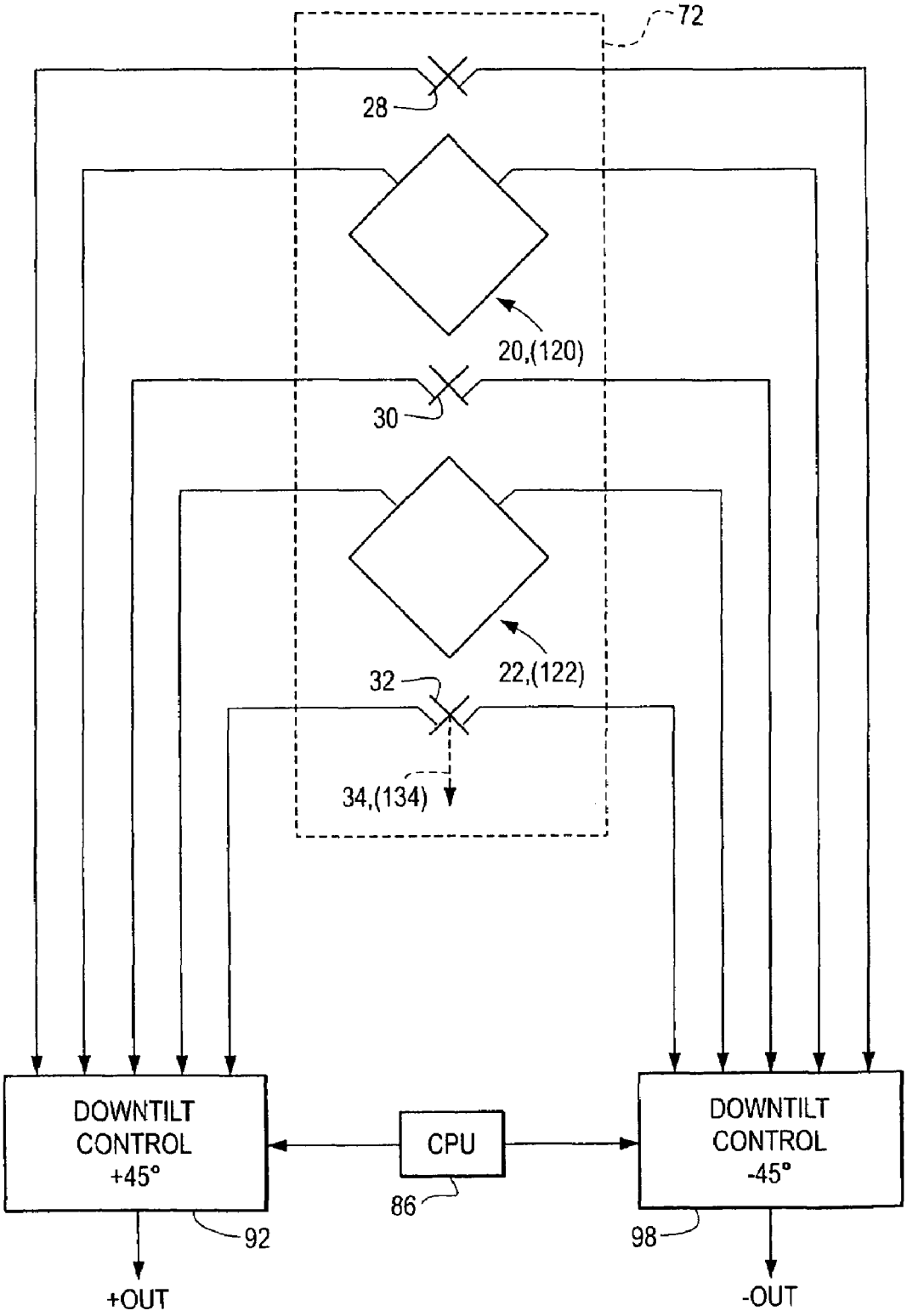
FIG. 6 is a simplified view of elements of the antenna of FIG. 1 operating in a third radio frequency band.

The downtilt of the third antenna 72 may also be changed, as necessary. In order to control downtilt of the third antenna 72, an incremental delay may be introduced into a signal from the sequence of elements including the first cross-type antenna 28, box-type array 36 of antenna assembly 20 (120), cross-type antenna 30, first box-type array 36 of antenna assembly 22 (122) and cross-type antenna 32. As shown in FIG. 6, a first set of parallel elements 46, 50 of assemblies 20, 22 (120, 122) and a first set of parallel elements of cross-type antenna 28, 30, 32 may be connected to a first downtilt controller 96. A second set of parallel elements 48, 52 of assemblies 20, 22 (120, 122) and of cross-type antenna 28, 30, 32 may be connected to a second downtilt controller 98.

In order to obtain a 2 degree change in downtilt, an appropriate incremental change in electrical length may be added to the signals from adjacent assemblies 28, 20 (120), 30, 22 (122). Further, a central processing unit (CPU) 86 and servo controller (not shown) may be used to adjust the downtilt of the third antenna 72. Based upon the control from the CPU 86, the downtilt of the plus and minus 45 degree polarized elements of the third antenna 72 may be adjusted together or independently based upon the needs of the signal receiving environment.

A specific embodiment of a method and apparatus of a method and apparatus for providing a multiband antenna according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A method of constructing an antenna comprising the steps of:

providing two or more combination-type dipole assemblies each defined by an inner dipole array disposed coaxially within an outer dipole array around an array center, each dipole in the inner array entirely disposed within an inner periphery of the outer dipole array when viewed in plan; and disposing the two or more combination-type dipole assemblies along a substantially straight line.

2. The method of constructing a multi-band antenna as in claim 1 further comprising aligning the outer dipole arrays and the inner dipole arrays so that each dipole in the inner dipole array is aligned parallel to an imaginary line between opposing ends of an adjacent dipole in the outer dipole array.

3. The method of constructing an antenna as in claim 2 further comprising rotating the combination-type dipole assemblies to form a plus and minus forty-five degree polarization angle with respect to the substantially straight line.

4. The method of constructing an antenna as in claim 3 further comprising allocating the outer dipole arrays of the plurality of combination-type dipole assemblies to a first frequency band.

5. The method of constructing an antenna as in claim 4 further comprising adjusting a downtilt for the outer dipole arrays of the plurality of combination-type dipole antenna assemblies allocated to the first frequency band.

6. The method of constructing an antenna as in claim 3 further comprising diposing a plurality of crossed-typed dipole antenna arrays along the substantially straight line in alternating order with the combination-type dipole assemblies, and allocating the alternating order of inner dipole arrays and crossed type dipole antenna arrays to a second frequency band.

7. The method of constructing an antenna as in claim 6 further comprising adjusting a downtilt of the alternating order of inner dipole arrays and crossed type dipole antenna arrays allocated to the second frequency band.

8. The method of constructing an antenna as in claim 3 further comprising disposing a plurality of crossed-typed dipole antenna arrays along the substantially straight line in alternating order with the combination-type dipole assemblies, and allocating a first portion of the alternating order of inner dipole arrays and plurality of crossed type dipole antenna arrays to a second frequency band.

9. The method of constructing an antenna as in claim 8 further comprising adjusting a downtilt of the first portion of the alternating order of inner dipole arrays and crossed type dipole antenna arrays allocated to the second frequency band.

10. The method of constructing an antenna as in claim 8 further comprising allocating a second group of the alternating order of inner dipole arrays and crossed type dipole antenna arrays to a third frequency band.

11. The method of constructing an antenna as in claim 10 further comprising adjusting a downtilt of the second portion of the alternating order of inner dipole arrays and crossed type dipole antenna arrays allocated to the third frequency band.

12. The method of constructing an antenna according to claim 1 further comprising disposing a plurality of crossed-type dipole antenna arrays along the substantially straight line in alternating order with the combination-type dipole assemblies.

13. The method of constructing an antenna according to claim 1, wherein each inner dipole array is a box-type dipole array.

14. The method of constructing an antenna according to claim 1, wherein each outer dipole array is a box-type dipole array.

15. The method of constructing an antenna according to claim 1, wherein each outer dipole array is a circular-type dipole array.

16. The method according to claim 1 wherein each dipole in the inner array and the outer array subtends an angle at the array center.

17. The method according to claim 1 wherein each dipole in the outer array is elongated.

18. The method according to claim 1 wherein each dipole in the outer array is a folded dipole.

19. An antenna comprising:

two or more combination-type dipole assemblies each defined by an inner dipole array disposed coaxially within an outer dipole array around an array center;

each dipole in the inner array entirely disposed within an inner periphery of the outer dipole array when viewed in plan;

and the plurality of combination-type dipole assemblies disposed along a substantially straight line.

20. The antenna as in claim 19 wherein the combination-type dipole arrays further comprise a set of aligned structures aligned so that each dipole in the inner dipole array is parallel to an imaginary line between opposing ends of an adjacent dipole in the outer dipole array.

21. The antenna as in claim 20 wherein the combination-type dipole assemblies further comprise rotated structures forming a plus and minus forty-five degree polarization angle with respect to the substantially straight line.

22. The antenna as in claim 21 wherein the outer dipole arrays further comprise dipoles operating within a first frequency band.

23. The antenna as in claim 22 further comprising a downtilt controller adapted to adjust a downtilt for the outer dipole arrays of the plurality of combination-type dipole antenna assemblies allocated to the first frequency band.

24. The antenna as in claim 21 further comprising a plurality of crossed-typed dipole antenna arrays diposed along the substantially straight line in alternating order with the plurality of combination-type dipole assemblies, wherein the alternating order of inner dipole arrays and crossed type dipole antenna arrays further comprise antenna elements operating in the second frequency band.

25. The antenna as in claim 24 further comprising a downtilt controller adapted to adjust a downtilt of the alternating order of inner dipole arrays and crossed type dipole antenna arrays allocated within the second frequency band.

26. The antenna as in claim 21 further comprising a plurality of crossed-typed dipole antenna arrays diposed along the substantially straight line in alternating order with the plurality of combination-type dipole assemblies, wherein a first portion of the alternating order of inner dipole arrays and crossed type dipole antenna arrays further comprise antenna elements operating in a second frequency band.

27. The antenna as in claim 26 further comprising a downtilt controller adapted to adjust a downtilt of the first portion of the alternating order of inner dipole arrays and crossed type dipole antenna arrays allocated to the second frequency band.

28. The antenna as in claim 27 wherein the second group of the alternating order of inner dipole arrays and crossed type dipole antenna arrays further comprise antenna elements operating within a third frequency band.

29. The antenna as in claim 28 further comprising a downtilt controller adapted to adjust a downtilt of the second portion of the alternating order of inner dipole arrays and crossed type dipole antenna arrays allocated to the third frequency band.

30. The antenna as in claim 19 further comprising a plurality of crossed-type dipole antenna arrays disposed along the substantially straight line in alternating order with the combination-type dipole assemblies.

31. The antenna as in claim 19, wherein each inner dipole array is a box-type dipole array.

32. The antenna as in claim 19, wherein each outer dipole array is a box-type dipole array.

33. The method of constructing an antenna according to claim 19, wherein each outer dipole array is a circular-type dipole array.

34. The method of constructing an antenna according to claim 19 further comprising disposing the combination-type dipole assemblies over a ground plane.

35. The method of constructing an antenna according to claim 19, wherein each inner dipole array is a box-type dipole array.

36. The method of constructing an antenna according to claim 19, wherein each outer dipole array is a box-type dipole array.

37. The method of constructing an antenna according to claim 19, wherein each outer dipole array is a circular-type dipole array.

38. The method according to claim 19 wherein each dipole in the inner array and the outer array subtends an angle at the array center.

39. The method according to claim 19 wherein each dipole in the outer array is elongated.

40. The method according to claim 19 wherein each dipole in the outer array is a folded dipole.

41. The method of constructing an antenna according to claim 1 further comprising disposing the combination-type dipole assemblies over a ground plane.

42. The antenna as in claim 19 wherein the combination-type dipole assemblies are disposed over a ground plane.

43. A method of constructing a dual-band antenna comprising the steps of:

disposing a box-type dipole array coaxially and entirely within a circular-type dipole array when viewed in plan to form a combination-type antenna assembly;

disposing a plurality of the combination-type dipole antenna assemblies along a substantially straight line over a ground plane; and disposing a plurality of crossed-type dipole antenna arrays along the substantially straight line in alternating order with the plurality of combination-type antenna assemblies.

* * * * *